US007154043B2

(12) United States Patent
Clark

(10) Patent No.: US 7,154,043 B2
(45) Date of Patent: Dec. 26, 2006

(54) DATA CABLE WITH CROSS-TWIST CABLED CORE PROFILE

(75) Inventor: William T. Clark, Lancaster, MA (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

(21) Appl. No.: 10/705,672

(22) Filed: Nov. 10, 2003

(65) Prior Publication Data

US 2005/0006132 A1 Jan. 13, 2005

Related U.S. Application Data

(63) Continuation-in-part of application No. 10/430,365, filed on May 5, 2003, now abandoned, which is a continuation of application No. 09/532,837, filed on Mar. 21, 2000, now Pat. No. 6,596,944, which is a continuation of application No. 08/841,440, filed on Apr. 22, 1997, now Pat. No. 6,074,503.

(51) Int. Cl.
*H01R 7/00* (2006.01)

(52) U.S. Cl. ..... 174/113 R; 174/113 C; 174/27

(58) Field of Classification Search ..... 174/110 R, 174/113 R, 113 C, 113 AS, 115, 116, 36, 174/27

See application file for complete search history.

(56) References Cited

U.S. PATENT DOCUMENTS

| | | | | |
|---|---|---|---|---|
| 867,659 | A | 10/1907 | Hoopes et al. | |
| 1,008,370 | A | 11/1911 | Robillot | |
| 1,132,452 | A | 3/1915 | Davis | |
| 1,700,606 | A | 1/1929 | Beaver | |
| 1,940,917 | A | 12/1933 | Okazaki | |
| 1,977,209 | A | 10/1934 | Sargent | |
| 1,995,201 | A | 3/1935 | Delon | |
| 2,218,830 | A | 10/1940 | Rose et al. | |
| 2,501,457 | A | 3/1950 | Thelin | |
| 2,583,025 | A * | 1/1952 | Swift et al. | 174/117 R |
| 2,583,026 | A * | 1/1952 | Swift | 174/117 R |
| 2,882,676 | A | 4/1959 | Bryan et al. | |
| 3,328,510 | A | 6/1967 | White | |
| 3,340,112 | A | 9/1967 | Davis et al. | |
| 3,559,390 | A | 2/1971 | Staschewski | |
| 3,603,715 | A | 9/1971 | Edhardt et al. | |
| 3,644,659 | A | 2/1972 | Campbell | |
| 3,649,744 | A | 3/1972 | Coleman | |
| 4,034,148 | A | 7/1977 | Lang | |
| 4,319,940 | A | 3/1982 | Arroyo et al. | |
| 4,487,992 | A | 12/1984 | Tomita | |
| RE32,225 | E | 8/1986 | Neuroth | |
| 4,654,476 | A | 3/1987 | Barnicol-Ottler et al. | |

(Continued)

FOREIGN PATENT DOCUMENTS

EP 1 162 632 A2 * 12/2001

*Primary Examiner*—William H. Mayo, III
(74) *Attorney, Agent, or Firm*—Lowrie, Lando & Anastasi, LLP.

(57) ABSTRACT

Cables including a plurality of twisted pairs of insulated conductors and a core disposed between the plurality of twisted pairs of insulated conductors so as to separate at least one of the plurality of twisted pairs of insulated conductors from others of the plurality of twisted pairs of insulated conductors. In one example, a cable may include a jacket having a plurality of protrusions. In another example, the core may include one or more pinch points to facilitate breaking of the core. In yet another example, two or more cables may be bundled, and possibly twisted, together to form a bundled cable.

23 Claims, 9 Drawing Sheets

U.S. PATENT DOCUMENTS 4,767,891 A 8/1988 Biegon et al.
4,777,325 A 10/1988 Siwinski
4,778,246 A 10/1988 Carroll
4,800,236 A 1/1989 Lemke
4,892,442 A * 1/1990 Shoffner ..... 405/183.5
4,912,283 A 3/1990 O'Connor
5,015,800 A 5/1991 Vaupotic et al.
5,043,530 A 8/1991 Davies
5,068,497 A 11/1991 Krieger
5,073,682 A 12/1991 Walling et al.
5,077,449 A 12/1991 Cornibert et al.
5,097,099 A 3/1992 Miller
5,132,488 A 7/1992 Tessier et al.
5,132,490 A 7/1992 Aldissi
5,142,100 A 8/1992 Faupotic
5,149,915 A 9/1992 Brunker et al.
5,155,304 A 10/1992 Gossett et al.
5,170,010 A 12/1992 Aldissi
5,180,890 A 1/1993 Pendergrass
5,220,130 A 6/1993 Walters
5,245,134 A 9/1993 Vana, Jr. et al.
5,298,680 A 3/1994 Kenny
5,304,739 A 4/1994 Klug et al.
5,313,020 A 5/1994 Sackett
5,399,813 A 3/1995 McNeill et al.
5,418,878 A 5/1995 Sass et al.
5,424,491 A 6/1995 Walling et al.
5,493,071 A 2/1996 Newmoyer
5,541,361 A 7/1996 Friesen et al.
5,544,270 A 8/1996 Clark et al.
5,574,250 A 11/1996 Hardie et al.
5,619,016 A * 4/1997 Newmoyer ..... 174/113 R
5,658,406 A 8/1997 Walling et al.
5,666,452 A 9/1997 Deitz, Sr. et al.
5,789,711 A * 8/1998 Gaeris et al. ..... 174/113 C
5,821,466 A 10/1998 Clark et al.
5,821,467 A 10/1998 O'Brian et al.
5,883,334 A 3/1999 Newmoyer et al.
5,900,588 A 5/1999 Springer et al.
5,952,607 A 9/1999 Friesen et al.
5,952,615 A 9/1999 Prudhon
5,956,445 A 9/1999 Deitz, Sr. et al.
5,969,295 A 10/1999 Boucino et al.
5,990,419 A 11/1999 Bogese, II
6,037,546 A 3/2000 Mottine et al.
6,074,503 A 6/2000 Clark et al.
6,091,025 A 7/2000 Cotter et al.
6,140,587 A * 10/2000 Sackett ..... 174/113 C
6,153,826 A 11/2000 Kenny et al.
6,162,992 A 12/2000 Clark et al.
6,169,251 B1 * 1/2001 Grant et al. ..... 174/113 R
6,194,663 B1 * 2/2001 Friesen et al. ..... 174/110 R
6,248,954 B1 * 6/2001 Clark et al. ..... 174/113 R
6,297,454 B1 * 10/2001 Gareis ..... 174/113 C
6,300,573 B1 10/2001 Horie et al.
6,303,867 B1 * 10/2001 Clark et al. ..... 174/113 R
6,355,876 B1 3/2002 Morimoto
6,365,836 B1 * 4/2002 Blouin et al. ..... 174/113 C
6,506,976 B1 * 1/2003 Neveux, Jr. ..... 174/113 R
6,570,095 B1 5/2003 Clark et al.
6,596,944 B1 7/2003 Clark et al.
6,639,152 B1 * 10/2003 Glew et al. ..... 174/113 C
6,800,811 B1 * 10/2004 Boucino ..... 174/113 C
2004/0055779 A1 3/2004 Wiekhorst et at.

* cited by examiner cross-hatching has been added to all twisted pairs

DATA CABLE WITH CROSS-TWIST CABLED CORE PROFILE

RELATED APPLICATIONS

This application is a continuation-in-part of, and claims priority under 35 U.S.C. § 120 to, U.S. application Ser. No. 10/430,365, entitled "Enhanced Data Cable With Cross-Twist Cabled Core Profile," filed on May 5, 2003 and now abandoned, which is a continuation of, and claims priority under 35 U.S.C. § 120 to, U.S. application Ser. No. 09/532,837 entitled "Enhanced Data Cable With Cross-Twist Cabled Core Profile,"filed on Mar. 21, 2000, now U.S. Pat. No. 6,596,944 which is a continuation of, and claims priority under 35 U.S.C. § 120 to, U.S. application Ser. No. 08/841,440, filed Apr. 22, 1997 entitled "Making Enhanced Data Cable with Cross-Twist Cabled Core Profile" (as amended) now U.S. Pat. No. 6,074,503, each of which is herein incorporated by reference in its entirety.

BACKGROUND OF THE INVENTION

1. Field of Invention

The present invention relates to high-speed data communications cables using at least two twisted pairs of wires. More particularly, it relates to cables having a central core defining plural individual pair channels.

2. Discussion of Related Art

High-speed data communications media include pairs of wire twisted together to form a balanced transmission line. Such pairs of wire are referred to as twisted pairs. One common type of conventional cable for high-speed data communications includes multiple twisted pairs that may be bundled and twisted (cabled) together to form the cable.

Modem communication cables must meet electrical performance characteristics required for transmission at high frequencies. The Telecommunications Industry Association and the Electronics Industry Association (TIA/EIA) have developed standards which specify specific categories of performance for cable impedance, attenuation, skew and crosstalk isolation. When twisted pairs are closely placed, such as in a cable, electrical energy may be transferred from one pair of a cable to another. Such energy transferred between pairs is referred to as crosstalk and is generally undesirable. The TIA/EIA have defined standards for crosstalk, including TIA/EIA-568A. The International Electrotechnical Commission (IEC) has also defined standards for data communication cable crosstalk, including ISO/IEC 11801. One high-performance standard for 100 Ω cable is ISO/IEC 11801, Category 5, another is ISO/IEC 11801 Category 6.

In conventional cable, each twisted pair of a cable has a specified distance between twists along the longitudinal direction, that distance being referred to as the pair lay. When adjacent twisted pairs have the same pair lay and/or twist direction, they tend to lie within a cable more closely spaced than when they have different pair lays and/or twist direction. Such close spacing may increase the amount of undesirable crosstalk which occurs between adjacent pairs. Therefore, in some conventional cables, each twisted pair within the cable may have a unique pair lay in order to increase the spacing between pairs and thereby to reduce the crosstalk between twisted pairs of a cable. Twist direction may also be varied.

Along with varying pair lays and twist directions, individual solid metal or woven metal pair shields are sometimes used to electromagnetically isolate pairs. Shielded cable, although exhibiting better crosstalk isolation, is more difficult and time consuming to install and terminate. Shielded conductors are generally terminated using special tools, devices and techniques adapted for the job.

One popular cable type meeting the above specifications is Unshielded Twisted Pair (UTP) cable. Because it does not include shielded conductors, UTP is preferred by installers and plant managers, as it may be easily installed and terminated. However, conventional UTP may fail to achieve superior crosstalk isolation, as required by state of the art transmission systems, even when varying pair lays are used.

Another solution to the problem of twisted pairs lying too closely together within a cable is embodied in a shielded cable manufactured by Belden Wire & Cable Company as product number 1711A. This cable includes four twisted pair media radially disposed about a "star"-shaped core. Each twisted pair nests between two fins of the "star"-shaped core, being separated from adjacent twisted pairs by the core. This helps reduce and stabilize crosstalk between the twisted pair media. However, the core adds substantial cost to the cable, as well as material which forms a potential fire hazard, as explained below, while achieving a crosstalk reduction of only about 5 dB. Additionally, the close proximity of the shield to the pairs within the cable requires substantially greater insulation thickness to maintain desired electrical characteristics. This adds more insulation material to the construction and increases cost.

In building design, many precautions are taken to resist the spread of flame and the generation of and spread of smoke throughout a building in case of an outbreak of fire. Clearly, it is desired to protect against loss of life and also to minimize the costs of a fire due to the destruction of electrical and other equipment. Therefore, wires and cables for in building installations are required to comply with the various flammability requirements of the National Electrical Code (NEC) and/or the Canadian Electrical Code (CEC).

Cables intended for installation in the air handling spaces (i.e. plenums, ducts, etc.) of buildings are specifically required by NEC or CEC to pass the flame test specified by Underwriters Laboratories Inc. (UL), UL-910, or it's Canadian Standards Association (CSA) equivalent, the FT6. The UL-910 and the FT6 represent the top of the fire rating hierarchy established by the NEC and CEC respectively. Cables possessing this rating, generically known as "plenum" or "plenum rated", may be substituted for cables having a lower rating (i.e. CMR, CM, CMX, FT4, FT1 or their equivalents), while lower rated cables may not be used where plenum rated cable is required.

Cables conforming to NEC or CEC requirements are characterized as possessing superior resistance to ignitability, greater resistant to contribute to flame spread and generate lower levels of smoke during fires than cables having a lower fire rating. Conventional designs of data grade telecommunications cables for installation in plenum chambers have a low smoke generating jacket material, e.g. of a PVC formulation or a fluoropolymer material, surrounding a core of twisted conductor pairs, each conductor individually insulated with a fluorinated ethylene propylene (FEP) insulation layer. Cable produced as described above satisfies recognized plenum test requirements such as the "peak smoke" and "average smoke" requirements of the Underwriters Laboratories, Inc., UL910 Steiner test and/or Canadian Standards Association CSA-FT6 (Plenum Flame Test) while also achieving desired electrical performance in accordance with EIA/FIA-568A for high frequency signal transmission.

While the above-described conventional cable, including the Belden 1711 A cable due in part to their use of FEP, meets all of the above design criteria, the use of fluorinated ethylene propylene is extremely expensive and may account for up to 60% of the cost of a cable designed for plenum usage.

The solid, relatively large core of the Belden 1711A cable may also contribute a large volume of fuel to a cable fire. Forming the core of a fire resistant material, such as FEP, is very costly due to the volume of material used in the core. Solid flame retardant/smoke suppressed polyolefin may also be used in combination with FEP. However, solid flame retardant/smoke suppressed polyolefin compounds commercially available all possess dielectric properties inferior to that of FEP. In addition, they also exhibit inferior resistance to burning and generally produce more smoke than FEP under burning conditions than FEP.

SUMMARY OF INVENTION

According to one embodiment, a data cable comprises a plurality of twisted pairs of insulated conductors, including a first twisted pair and a second twisted pair, and a core disposed between the plurality of twisted pairs of insulated conductors so as to separate the first twisted pair from the second twisted pair along a length of the data cable, wherein the core comprises at least one pinch point where a diameter of the core is substantially reduced relative to a maximum diameter of the core.

In another embodiment, a shielded cable comprises a plurality of twisted pairs of insulated conductors, including a first twisted pair and a second twisted pair, a core disposed between the plurality of twisted pairs of insulated conductors so as to separate the first twisted pair from the second twisted pair along a length of the data cable, a dual-layer jacket enclosing the core and the plurality of twisted pairs of insulated conductors, the dual-layer jacket including a first jacket layer and a second jacket layer, and a conductive shield disposed between the first jacket layer and the second jacket layer.

According to another embodiment, a bundled cable comprises a first cable including a plurality of twisted pairs of insulated conductors and a first separator arranged between the plurality of twisted pairs so as to separate one of the plurality of twisted pairs from others of the plurality of twisted pairs, the first cable having a first jacket, and a second cable including a plurality of twisted pairs of insulated conductors and a second separator arranged between the plurality of twisted pairs so as to separate one of the plurality of twisted pairs from others of the plurality of twisted pairs, the second cable having a second jacket, wherein each of the first and second jackets comprises a plurality of protrusions. In one example, the plurality of protrusions of each of the first and second jackets are outwardly projecting, and the first and second jackets are adapted to mate with one another so as to lock the first cable to the second cable. In another example, the plurality of protrusions of the first or second jacket are inwardly projecting.

According to another embodiment, a cable comprises a plurality of twisted pairs of insulated conductors including a first twisted pair and a second twisted pair, a core disposed between the plurality of twisted pairs of insulated conductors so as to separate the first twisted pair from the second twisted pair, and a jacket surrounding the plurality of twisted pairs of insulated conductors and the core, wherein the first twisted pair has a first twist lay and a first insulation thickness, wherein the second twisted pair has a second twist lay, smaller than the first twist lay, and a second insulation thickness, and wherein a skew between the first and second twisted pairs is less than about 7 nanoseconds.

BRIEF DESCRIPTION OF DRAWINGS

In the drawings, which are not intended to be drawn to scale, each identical or nearly identical component that is illustrated in various figures is represented by a like numeral. For purposes of clarity, not every component may be labeled in every drawing. The drawings are provided for the purposes of illustration and explanation and are not intended as a definition of the limits of the invention. In the drawings.

DETAILED DESCRIPTION

Figure 1:
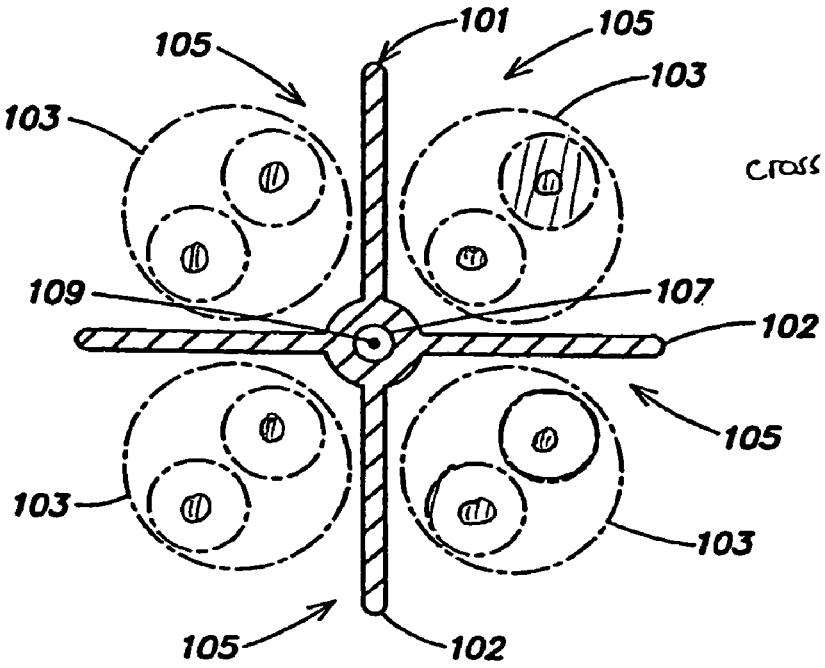
FIG. 1 is a cross-sectional view of a cable core according to one embodiment of the invention.

Various illustrative embodiments and aspects thereof will now be described in detail with reference to the accompanying figures. It is to be appreciated that this invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Referring to FIG. 1, there is illustrated one embodiment of portions of a cable including an extruded core 101 having a profile described below cabled into the cable with four twisted pairs 103. Although the following description will refer primarily to a cable that is constructed to include four twisted pairs of insulated conductors and a core having a unique profile, it is to be appreciated that the invention is not limited to the number of pairs or the profile used in this embodiment. The inventive principles can be applied to cables including greater or fewer numbers of twisted pairs and different core profiles. Also, although this embodiment of the invention is described and illustrated in connection with twisted pair data communication media, other high-speed data communication media can be used in constructions of cable according to the invention.

As shown in FIG. 1, according to one embodiment of the invention, the extruded core profile may have an initial shape of a "+", providing four spaces or channels 105, one between each pair of fins 102 of the core 101. Each channel 105 carries one twisted pair 103 placed within the channel 105 during the cabling operation. The illustrated core 101 and profile should not be considered limiting. The core 101 may be made by some other process than extrusion and may have a different initial shape or number of channels 105. For example, as illustrated in FIG. 1, the core may be provided with an optional central channel 107 that may carry, for example, an optical fiber element or strength element 109. In addition, in some examples, more than one twisted pair 103 may be placed in each channel 105.

The above-described embodiment can be constructed using a number of different materials. While the invention is not limited to the materials now given, the invention is advantageously practiced using these materials. The core material should be a conductive material or one containing a powdered ferrite, the core material being generally compatible with use in data communications cable applications, including any applicable fire safety standards. In non-plenum applications, the core can be formed of solid or foamed flame retardant polyolefin or similar materials. The core may also be formed of non-flame retardant materials. In plenum applications, the core can be any one or more of the following compounds: a solid low dielectric constant fluoropolymer, e.g., ethylene chlortrifluoroethylene (E-CTFE) or fluorinated ethylene propylene (FEP), a foamed fluoropolymer, e.g., foamed FEP, and polyvinyl chloride (PVC) in either solid, low dielectric constant form or foamed. A filler is added to the compound to render the extruded product conductive. Suitable fillers are those compatible with the compound into which they are mixed, including but not limited to powdered ferrite, semiconductive thermoplastic elastomers and carbon black. Conductivity of the core helps to further isolate the twisted pairs from each other.

A conventional four-pair cable including a non-conductive core, such as the Belden 1711A cable, reduces nominal crosstalk by up to 5 dB over similar, four-pair cable without the core. By making the core conductive, crosstalk is reduced a further 5 dB. Since both loading of the core and jacket construction can affect crosstalk, these numbers compare cables with similar loading and jacket construction.

Figure 2:
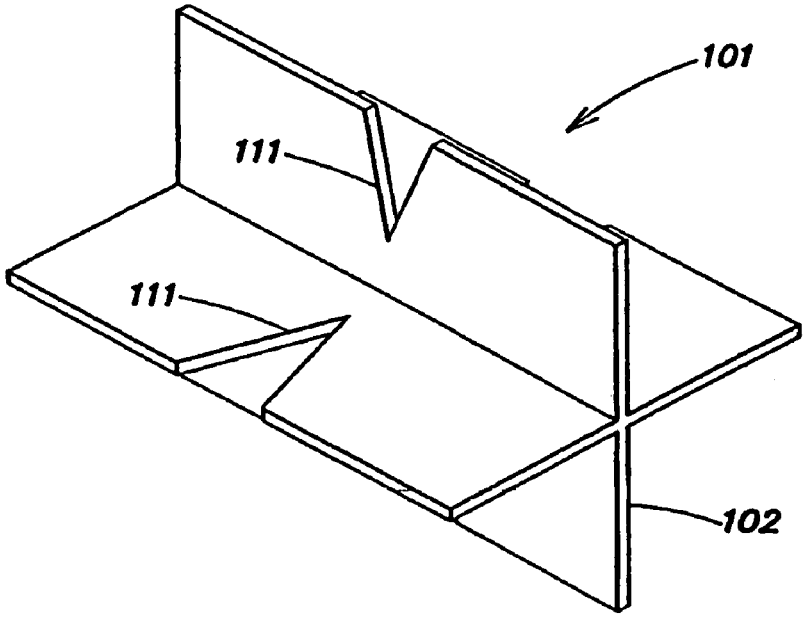
FIG. 2 is perspective view of one embodiment of a perforated core according to the invention.

As discussed above, the core 101 may have a variety of different profiles and may be conductive or non-conductive. According to one embodiment, the core 101 may further include features that may facilitate removal of the core 101 from the cable. For example, referring to FIG. 2, the core 101 may be provided with narrowed, or notched, sections 111, which are referred to herein as "pinch points." At the notched sections, or pinch points, a diameter or size of the core 101 is reduced compared with the normal size of the core 101 (at the non-pinch point sections of the core). Thus, the pinch points 111 provide points at which it may be relatively easy to break the core 101. The pinch points 111 may act as "perforations" along the length of the core, facilitating snapping of the core at these points, which in turn may facilitate removal of sections of the core 101 from the cable. This may be advantageous for being able to easily snap the core to facilitate terminating the cable with, for example, a telephone or data jack or plug. In one example, the pinch points 111 may be placed at intervals of approximately 0.5 inches along the length of the cable. The pinch points 111 should be small enough such that the twisted pairs may ride over the pinch points 111 substantially without dipping closer together through the notched sections 111. In one example, the pinch points may be formed during extrusion of the core by stretching the core for a relatively short period of time each time it is desired to form a pinch point 111. Stretching the core during extrusion results in "thinned" or narrowed sections being created in the core which form the pinch points 111.

Figure 3:
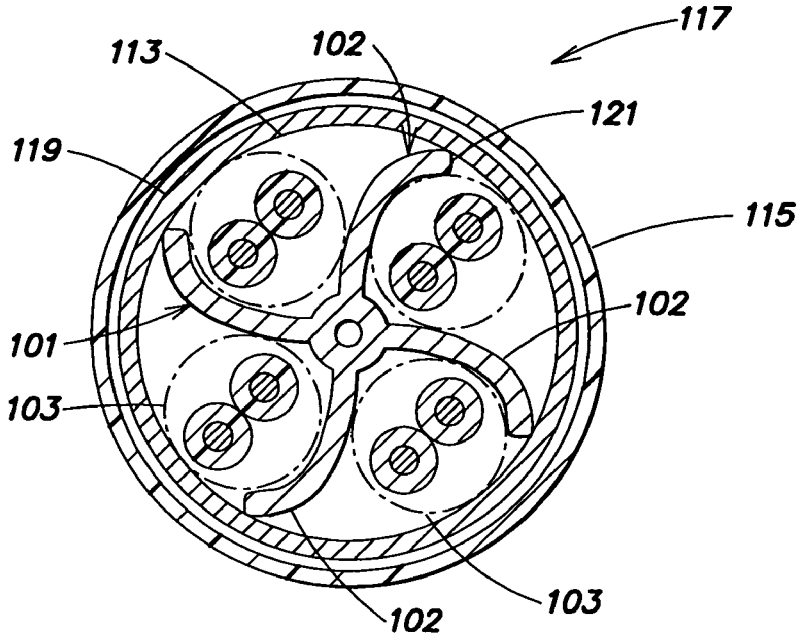
FIG. 3 is a cross-sectional view of one embodiment of a cable including the core of FIG. 1.

The cable may be completed in any one of several ways, for example, as shown in FIG. 3. The combined core 101 and twisted pairs 103 may be optionally wrapped with a binder 113 and then jacketed with a jacket 115 to form cable 117. In one example, an overall conductive shield 117 can optionally be applied over the binder 111 before jacketing to prevent the cable from causing or receiving electromagnetic interference. The jacket 115 may be PVC or another material as discussed above in relation to the core 101. The binder 113 may be, for example, a dielectric tape which may be polyester, or another compound generally compatible with data communications cable applications, including any applicable fire safety standards. It is to be appreciated that the cable can be completed without either or both of the binder and the conductive shield, for example, by providing the jacket.

As is known in this art, when plural elements are cabled together, an overall twist is imparted to the assembly to improve geometric stability and help prevent separation. In some embodiments of a process of manufacturing the cable of the invention, twisting of the profile of the core along with the individual twisted pairs is controlled. The process includes providing the extruded core to maintain a physical spacing between the twisted pairs and to maintain geometrical stability within the cable. Thus, the process assists in the achievement of and maintenance of high crosstalk isolation by placing a conductive core in the cable to maintain pair spacing.

Figure 4:
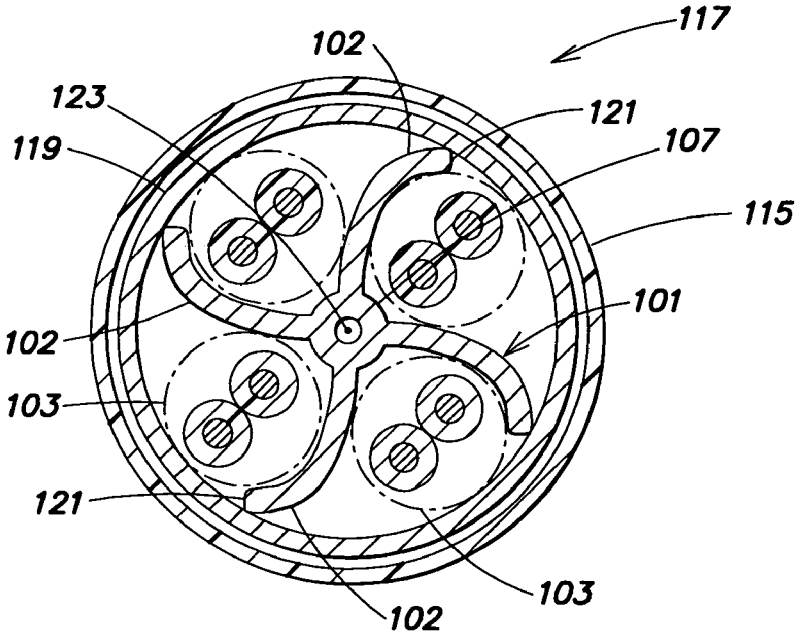
FIG. 4 is a cross-sectional view of another embodiment of a cable core used in some embodiments of the cable of the invention.

According to another embodiment, greater cross-talk isolation may achieved in the construction of FIG. 4 by using a conductive shield 119, for example a metal braid, a solid metal foil shield or a conductive plastic layer in contact with the ends 121 of the fins 102 of the core 101. In such an embodiment, the core is preferably conductive. Such a construction rivals individual shielding of twisted pairs for cross-talk isolation. This construction optionally can advantageously include a drain wire 123 disposed in the central channel 107, as illustrated in FIG. 4. In some examples, it may be advantageous to have the fins 102 of the core 101 extend somewhat beyond a boundary defined by the outer dimension of the twisted pairs 103. As shown in FIG. 4, this helps to ensure that the twisted pairs 103 do not escape their respective channels 105 prior to the cable being jacketed, and may also facilitate good contact between the fins 102 and the shield 119. In the illustrated example, closing and jacketing the cable 117 may bend the ends 121 of the fins 102 over slightly, as shown, if the core material is a relatively soft material, such as PVC.

Figure 5:
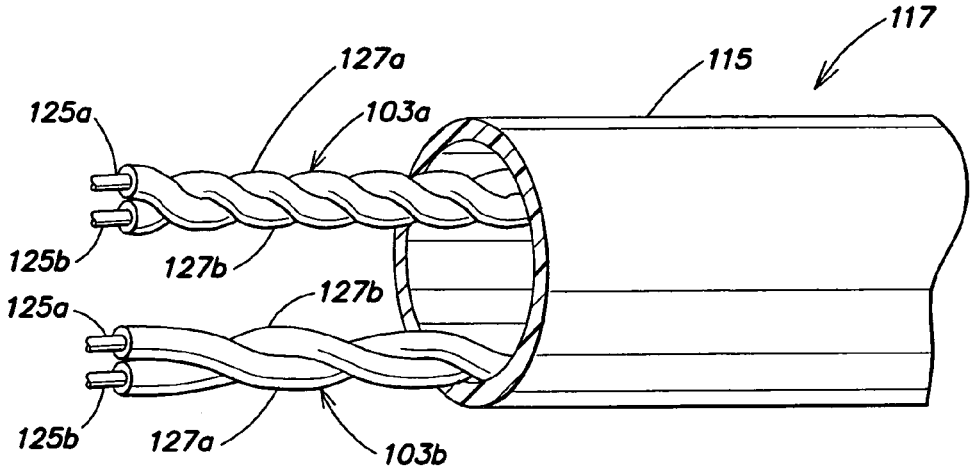
FIG. 5 is an illustration of one embodiment of a cable comprising twisted pairs having varying twist lays according to the invention.

In some embodiments, particularly where the core 101 may be non-conductive, it may be advantageous to provide additional crosstalk isolation between the twisted pairs 103 by varying the twist lays of each twisted pair 103. For example, referring to FIG. 5, the cable 117 may include a first twisted pair 103*a* and a second twisted pair 103*b*. Each of the twisted pairs 103*a*, 103*b* includes two metal wires 125*a*, 125*b* each insulated by an insulating layer 127*a*, 127*b*. As shown in FIG. 5, the first twisted pair 103*a* may have a twist lay length that is shorter than the twist lay length of the second twisted pair 103*b*.

As discussed above, varying the twist lay lengths between the twisted pairs in the cable may help to reduce crosstalk between the twisted pairs. However, the shorter a pair's twist lay length, the longer the "untwisted length" of that pair and thus the greater the signal phase delay added to an electrical signal that propagates through the twisted pair. It is to be understood that the term "untwisted length" herein denotes the electrical length of the twisted pair of conductors when the twisted pair of conductors has no twist lay (i.e., when the twisted pair of conductors is untwisted). Therefore, using different twist lays among the twisted pairs within a cable may cause a variation in the phase delay added to the signals propagating through different ones of the conductors pairs. It is to be appreciated that for this specification the term "skew" is a difference in a phase delay added to the electrical signal for each of the plurality of twisted pairs of the cable. Therefore, a skew may result from the twisted pairs in a cable having differing twist lays. As discussed above, the TIA/EIA has set specifications that dictate that cables, such as category 5 or category 6 cables, must meet certain skew requirements.

Figure 6:
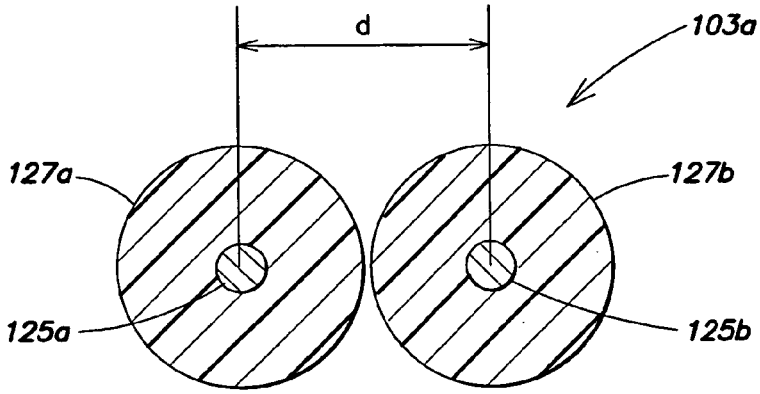
FIG. 6 is a cross-sectional view of a twisted pair of insulated conductors.

In addition, in order to impedance match a cable to a load (e.g., a network component), the impedance of a cable may be rated with a particular characteristic impedance. For example, many radio frequency (RF) components may have characteristic impedances of 50 or 100 Ohms. Therefore, many high frequency cables may similarly be rated with a characteristic impedance of 50 or 100 Ohms so as to facilitate connecting of different RF loads. The characteristic impedance of the cable may generally be determined based on a composite of the individual nominal impedances of each of the twisted pairs making up the cable. Referring to FIG. 6, the nominal impedance of a twisted pair 103*a* may be related to several parameters including the diameter of the wires 125*a*, 125*b* of the twisted pairs making up the cable, the center-to-center distance d between the conductors of the twisted pairs, which may in turn depend on the thickness of the insulating layers 127*a*, 127*b*, and the dielectric constant of the material used to insulate the conductors.

The nominal characteristic impedance of each pair may be determined by measuring the input impedance of the twisted pair over a range of frequencies, for example, the range of desired operating frequencies for the cable. A curve fit of each of the measured input impedances, for example, up to 801 measured points, across the operating frequency range of the cable may then be used to determine a "fitted" characteristic impedance of each twisted pair making up the cable, and thus of the cable as a whole. The TIA/EIA specification for characteristic impedance is given in terms of this fitted characteristic impedance. For example, the specification for a category 5 or 6 100 Ohm cable is 100 Ohms, +−15 Ohms for frequencies between 100 and 350 MHz and 100 Ohms +−12 Ohms for frequencies below 100 MHz.

In conventional manufacturing, it is generally considered more beneficial to design and manufacture twisted pairs to achieve as close to the specified characteristic impedance of the cable as possible, generally within plus or minus 2 Ohms. The primary reason for this is to take into account impedance variations that may occur during manufacture of the twisted pairs and the cable. The further away from the specified characteristic impedance a particular twisted pair is, the more likely a momentary deviation from the specified characteristic impedance at any particular frequency due to impedance roughness will exceed limits for both input impedance and return loss of the cable.

As the dielectric constant of an insulation material covering the conductors of a twisted pair decreases, the velocity of propagation of a signal traveling through the twisted pair of conductors increases and the phase delay added to the signal as it travels through the twisted pair decreases. In other words, the velocity of propagation of the signal through the twisted pair of conductors is inversely proportional to the dielectric constant of the insulation material and the added phase delay is proportional to the dielectric constant of the insulation material. For example, referring again to FIG. 6, for a so-called "faster" insulation, such as fluoroethylenepropylene (FEP), the propagation velocity of a signal through the twisted pair 103*a* may be approximately 0.69 c (where c is the speed of light in a vacuum). For a "slower" insulation, such as polyethylene, the propagation velocity of a signal through the twisted pair 103*a* may be approximately 0.66 c.

The effective dielectric constant of the insulation material may also depend, at least in part, on the thickness of the insulating layer. This is because the effective dielectric constant may be a composite of the dielectric constant of the insulating material itself in combination with the surrounding air. Therefore, the propagation velocity of a signal through a twisted pair may also depend on the thickness of the insulation of that twisted pair. However, as discussed above, the characteristic impedance of a twisted pair also depends on the insulation thickness.

Applicant has recognized that by optimizing the insulation diameters relative to the twist lays of each twisted pair in the cable, the skew can be substantially reduced. Although varying the insulation diameters may cause variation in the characteristic impedance values of the twisted pairs, under improved manufacturing processes, impedance roughness over frequency (i.e., variation of the impedance of any one twisted pair over the operating frequency range) can be controlled to be reduced, thus allowing for a design optimized for skew while still meeting the specification for impedance.

According to one embodiment of the invention, a cable may comprise a plurality of twisted pairs of insulated conductors, wherein twisted pairs with longer pair lays have a relatively higher characteristic impedance and larger insulation diameter, while twisted pairs with shorter pair lays have a relatively lower characteristic impedance and smaller insulation diameter. In this manner, pair lays and insulation thickness may be controlled so as to reduce the overall skew of the cable. One example of such a cable, using polyethylene insulation is given in Table 1 below.

TABLE 1

| Twisted Pair | Twist Lay Length (inches) | Diameter of Insulation (inches) |
|---|---|---|
| 1 | 0.504 | 0.042 |
| 2 | 0.744 | 0.040 |
| 3 | 0.543 | 0.041 |
| 4 | 0.898 | 0.040 |

Figure 7:
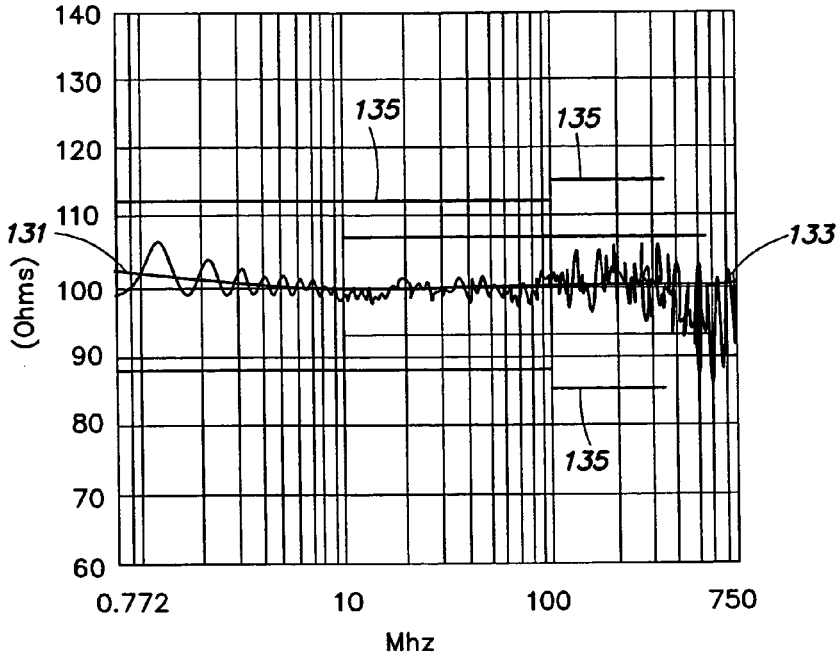
FIG. 7 is a graph of impedance versus frequency for a twisted pair of conductors according to the invention.
Figure 8:
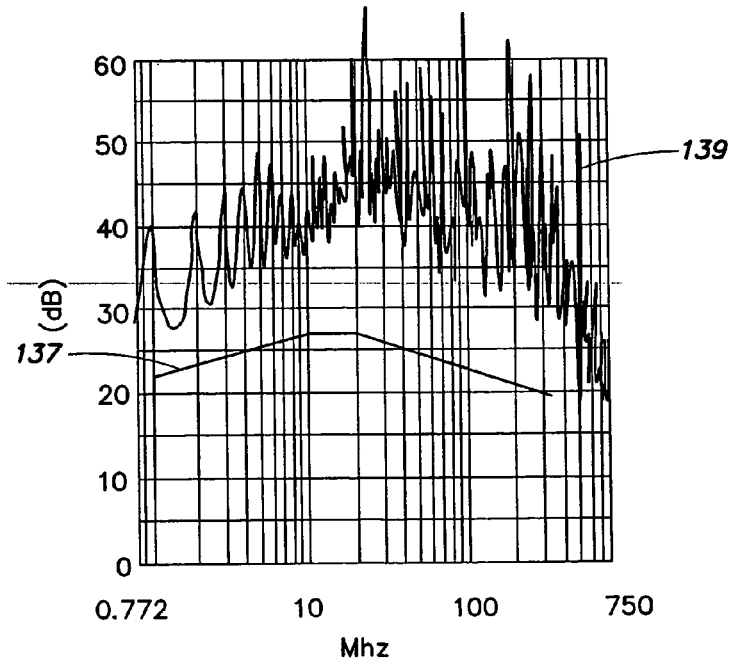
FIG. 8 is a graph of return loss versus frequency for the twisted pair of FIG. 7.

This concept may be better understood with reference to FIGS. 7 and 8 which respectively illustrate graphs of measured input impedance versus frequency and return loss versus frequency for twisted pair 1, for example, twisted pair 103*a*, in the cable 117. Referring to FIG. 7, a "fitted" characteristic impedance 131 for the twisted pair (over the operating frequency range) may be determined from the measured input impedance 133 over the operating frequency range. Lines 135 indicate the category 5/6 specification range for the input impedance of the twisted pair. As shown in FIG. 7, the measured input impedance 133 falls within the specified range over the operating frequency range of the cable 117. Referring to FIG. 8, there is illustrated a corresponding return loss versus frequency plot for the twisted pair 103*a*. The line 137 indicates the category 5/6 specification for return loss over the operating frequency range. As shown in FIG. 8, the measured return loss 139 is above the specified limit (and thus within specification) over the operating frequency range of the cable. Thus, the characteristic impedance could be allowed to deviate further from the desired 100 Ohms, if necessary, to reduce skew. Similarly, the twist lays and insulation thicknesses of the other twisted pairs may be further varied to reduce the skew of the cable while still meeting the impedance specification.

According to another embodiment, a four-pair cable was designed, using slower insulation material (e.g., polyethylene) and using the same pair lays as shown in Table 1, where all insulation diameters were set to 0.041 inches. This cable exhibited a skew reduction of about 8 ns/100 meters (relative to the conventional cable described above—this cable was measured to have a worst case skew of approximately 21 ns whereas the conventional, impedance-optimized cable exhibits a skew of approximately 30 ns or higher), yet the individual pair impedances were within 0 to 2.5 ohms of deviation from nominal, leaving plenty of room for further impedance deviation, and therefore skew reduction.

Allowing some deviation in the twisted pair characteristic impedances relative to the nominal impedance value allows for a greater range of insulation diameters. Smaller diameters for a given pair lay results in a lower pair angle and shorter non-twisted pair length. Conversely, larger pair diameters result in a higher pair angles and longer non-twisted pair length. Where a tighter pair lay would normally require an insulation diameter of 0.043" for 100 ohms, a diameter of 0.041" would yield a reduced impedance of about 98 ohms. Longer pair lays using the same insulation material would require a lower insulation diameter of about 0.039" for 100 ohms, and a diameter of 0.041" would yield about 103 ohms. As shown in FIGS. 7 and 8, allowing this "target" impedance variation from 100 Ohms may not prevent the twisted pairs, and the cable, from meeting the input impedance specification, but may allow improved skew in the cable.

Figure 9A:
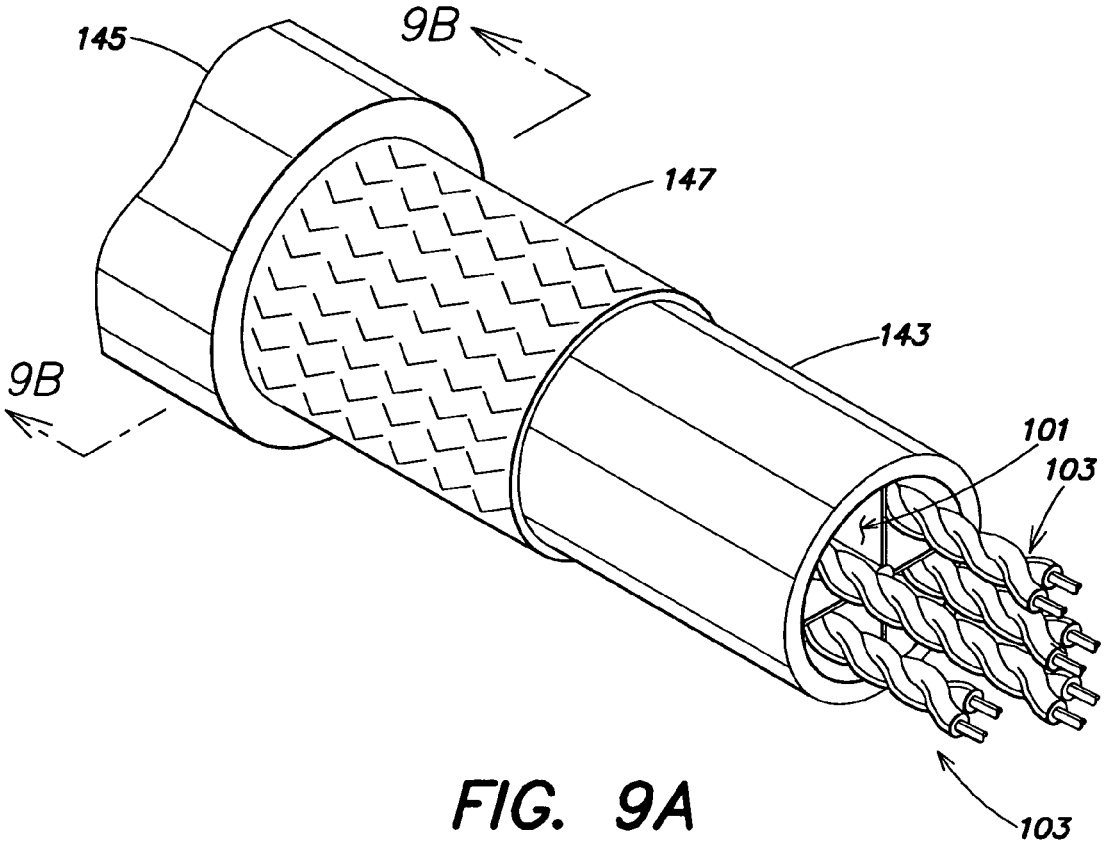
FIG. 9A is a perspective view of a cable having a dual-layer jacket according to the invention.
Figure 9B:
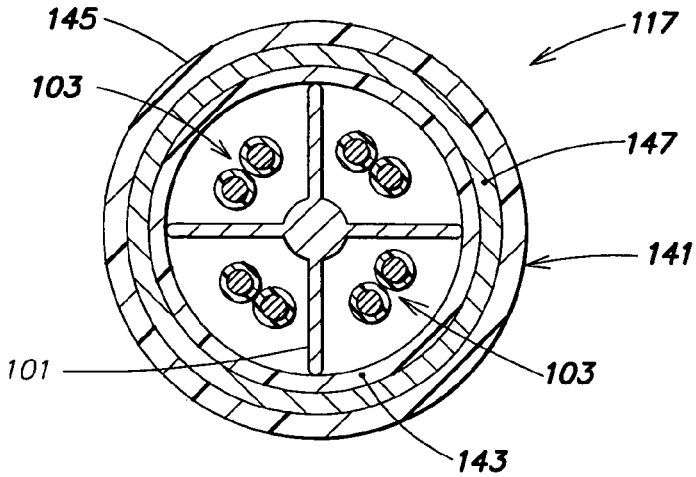
FIG. 9B is a cross-sectional view of the cable of FIG. 9A, taken along line B-B in FIG. 9A.

According to another embodiment, illustrated in FIGS. 9A and 9B, the cable 117 may be provided with a dual-layer jacket 141 comprising a first, inner layer 143 and a second, outer layer 145. An optional conductive shield 147 may be placed between the first and second jacket layers 143, 145, as illustrated. The shield 147 may act to prevent crosstalk between adjacent or nearby cables, commonly called alien crosstalk. The shield 147 may be, for example, a metal braid or foil that extends partially or substantially around the first jacket layer 143 along the length of the cable. The shield 147 may be isolated from the twisted pairs 103 by the first jacket layer 143 and may thus have little impact on the twisted pairs. This may be advantageous in that small or no adjustment may need to be made to, for example conductor or insulation thicknesses of the twisted pairs 103. The first and second jacket layers may be any suitable jacket material, such as, PVC, fluoropolymers, fire and/or smoke resistant materials, and the like. In this embodiment, because the shield is isolated from the twisted pairs 103 and the separator 101 by the first jacket layer 143, the separator 101 may be conductive or non-conductive.

According to another embodiment, several cables such as those described above may be bundled together to provide a bundled cable. Within the bundled cable may be provided numerous embodiments of the cables described above. For example, the bundled cable may include some shielded and some unshielded cables, some four-pair cables and some having a different number of pairs. In addition, the cables making up the bundled cable may include conductive or non-conductive cores having various profiles. In one example, the multiple cables making up the bundled cable may be helically twisted together and wrapped in a binder. The bundled cable may include a rip-cord to break the binder and release the individual cables from the bundle.

Figure 10:
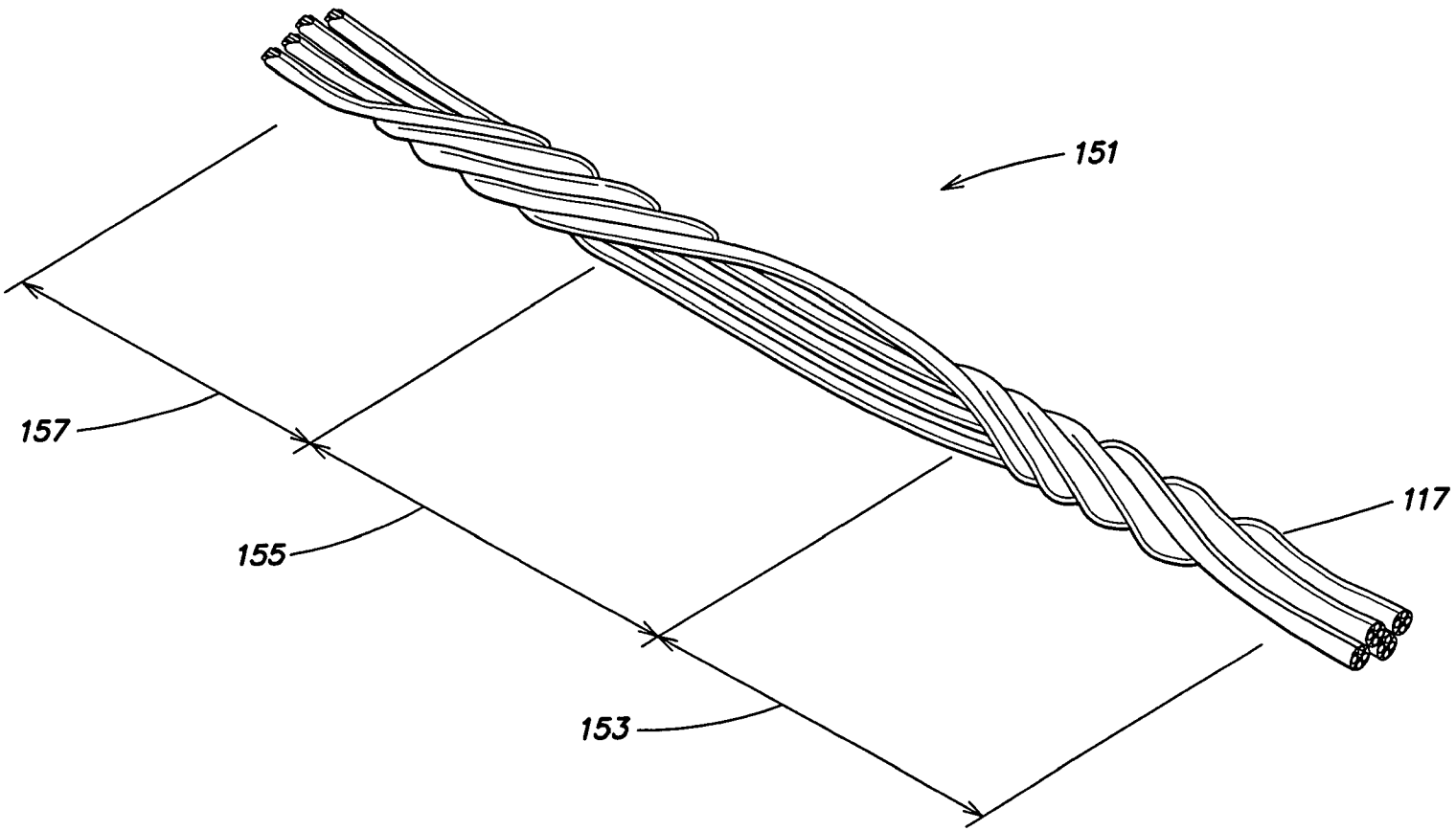
FIG. 10 is a perspective view of one embodiment of a bundled cable according to the invention, illustrating oscillating cabling.

According to one embodiment, illustrated in FIG. 10, the bundled cable 151 may be cabled in an oscillating manner along its length rather than cabled in one single direction along the length of the cable. In other words, the direction in which the cable is twisted (cabled) along its length may be changed periodically from, for example, a clockwise twist to an anti-clockwise twist, and vice versa. This is known in the art as SZ type cabling and may require the use of a special twisting machine known as an oscillator cabler. In some examples of bundled cables 151, each individual cable 117 making up the bundled cable 151 may itself be helically twisted (cabled) with a particular cable lay length, for example, about 5 inches. The cable lay of each cable may tend to either loosen (if in the opposite direction) or tighten (if in the same direction) the twist lays of each of the twisted pairs making up the cable. If the bundled cable 151 is cabled in the same direction along its whole length, this overall cable lay may further tend to loosen or tighten the twist lays of each of the twisted pairs. Such altering of the twist lays of the twisted pairs may adversely affect the performance of at least some of the twisted pairs and/or the cables 117 making up the bundled cable 151. However, helically twisting the bundled cable may be advantageous in that it may allow the bundled cable to be more easily bent, for example, in storage or when being installed around corners. By periodically reversing the twist lay of the bundled cable, any effect of the bundled twist on the individual cables may be substantially canceled out. In one example, the twist lay of the bundled cable may be approximately 20 inches in either direction. As shown in FIG. 10, the bundled cable may be twisted for a certain number of twist lays in a first direction (region 153), then not twisted for a certain length (region 155), and then twisted in the opposite direction for a number of twist lays (region 157).

Figure 11:
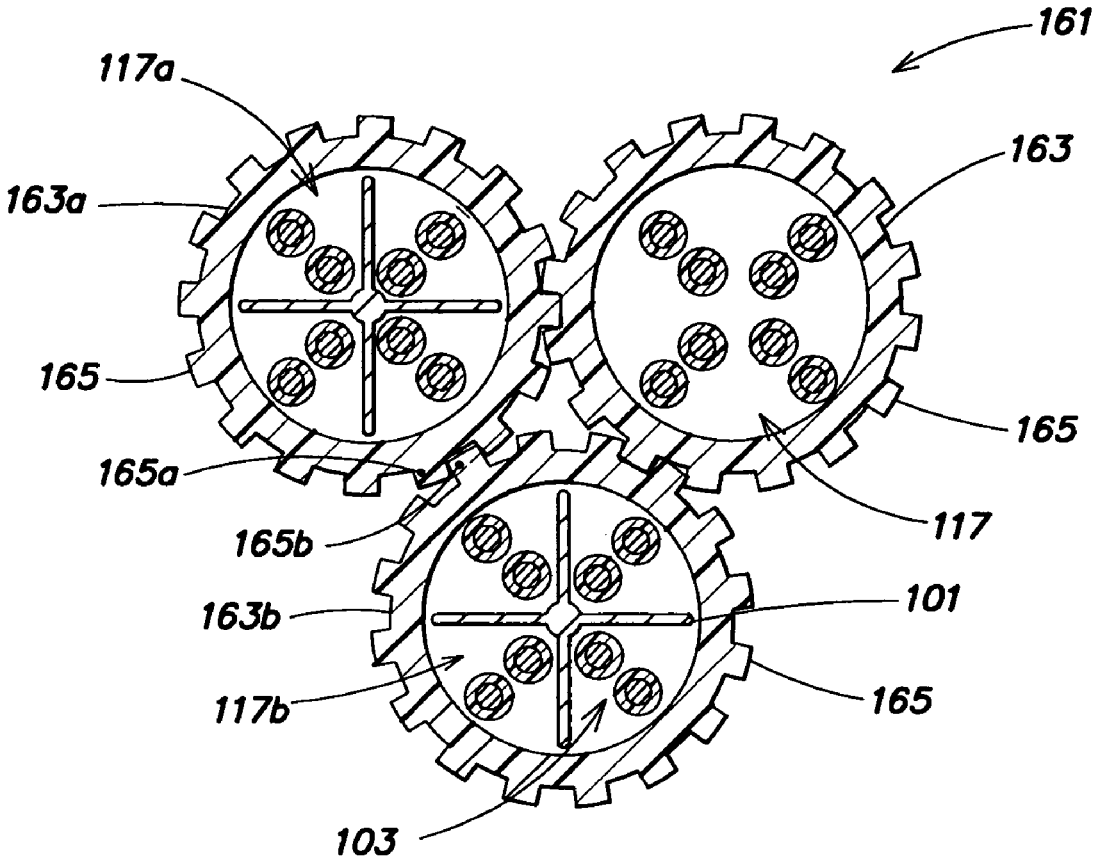
FIG. 11 is an illustration of another embodiment of a bundled cable including a plurality of cables having interlocking striated jackets, according to the invention.

Referring to FIG. 11, there is illustrated another embodiment of a bundled cable 161 according to the invention. In this embodiment, one or more of the individual cables 117 making up the bundled cable 161 may have a striated jacket 163, as shown. The striated jacket 163 may have a plurality of protrusions 165 spaced about a circumference of the jacket 163. In one example, the cables 117 may not be twisted with a cable lay. In this example, the protrusions 165 may be constructed such that the protrusions 165*a* of one jacket 163*a* may mate with the protrusions 165*b* of another jacket 163*b* so as to interlock two corresponding cables 117*a*, 117*b* together. Thus, the individual cables 117 making up the bundled cable 161 may "snap" together, possibly obviating the need for a binder to keep the bundled cable 161 together. This embodiment may be advantageous in that the cables 117 may be easily separated from one another when necessary.

Figure 12:
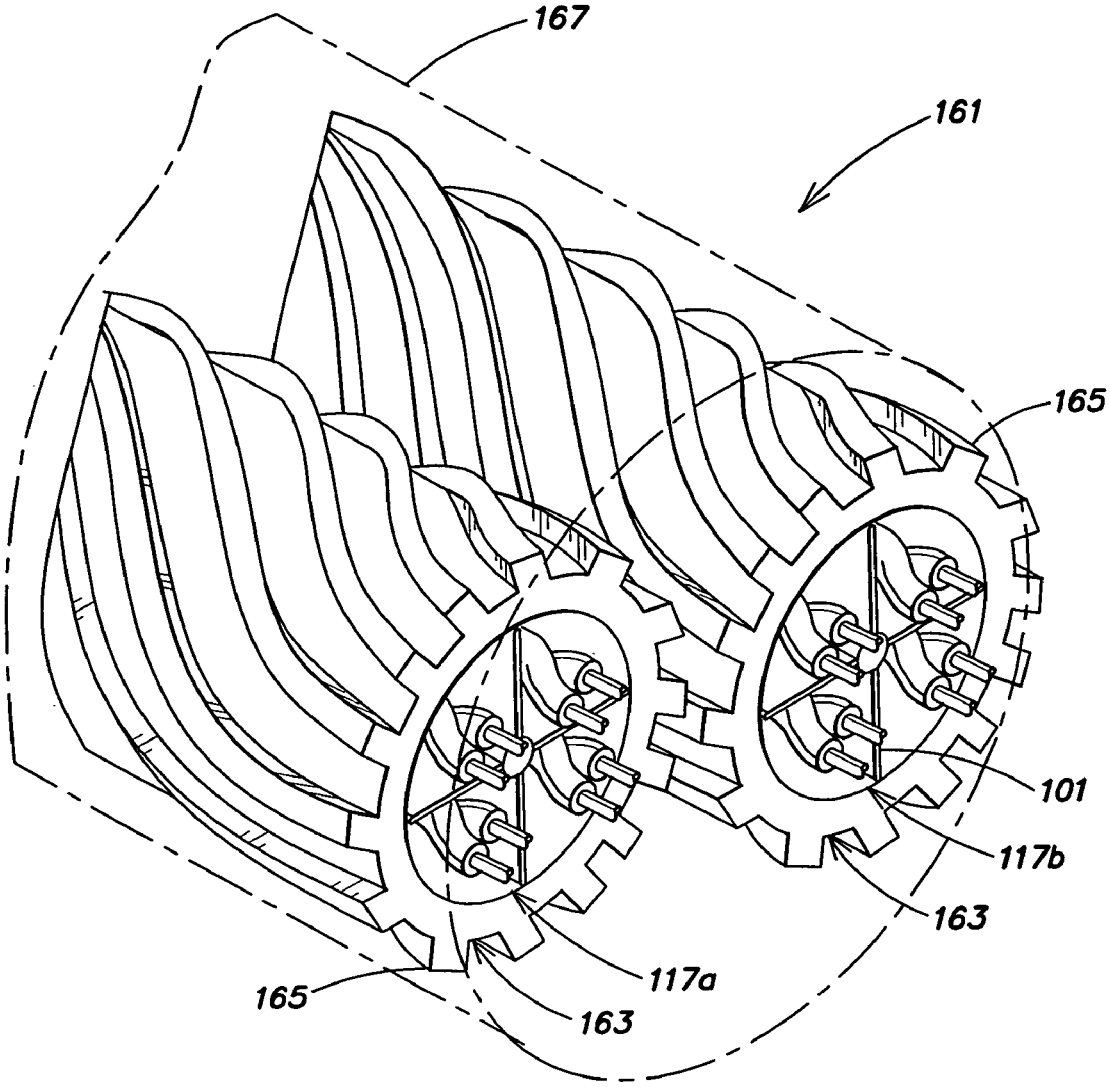
FIG. 12 is a perspective view of another embodiment of a bundled cable including a plurality of cables having striated jackets, according to the invention.

In another example, the individual cables 117 may be helically twisted with a cable lay. In this example, the protrusions 165 may form helical ridges along the length of the cables 117, as shown in FIG. 12. The protrusions 165 may thus serve to further separate one cable 117*a* from another 117*b*, and may thereby act to reduce alien crosstalk between cables 117*a*, 117*b*. The plurality of cables 117 may be wrapped in, for example, a binder 167 to bundle the cables 117 together and form the bundled cable 161.

Figure 13:
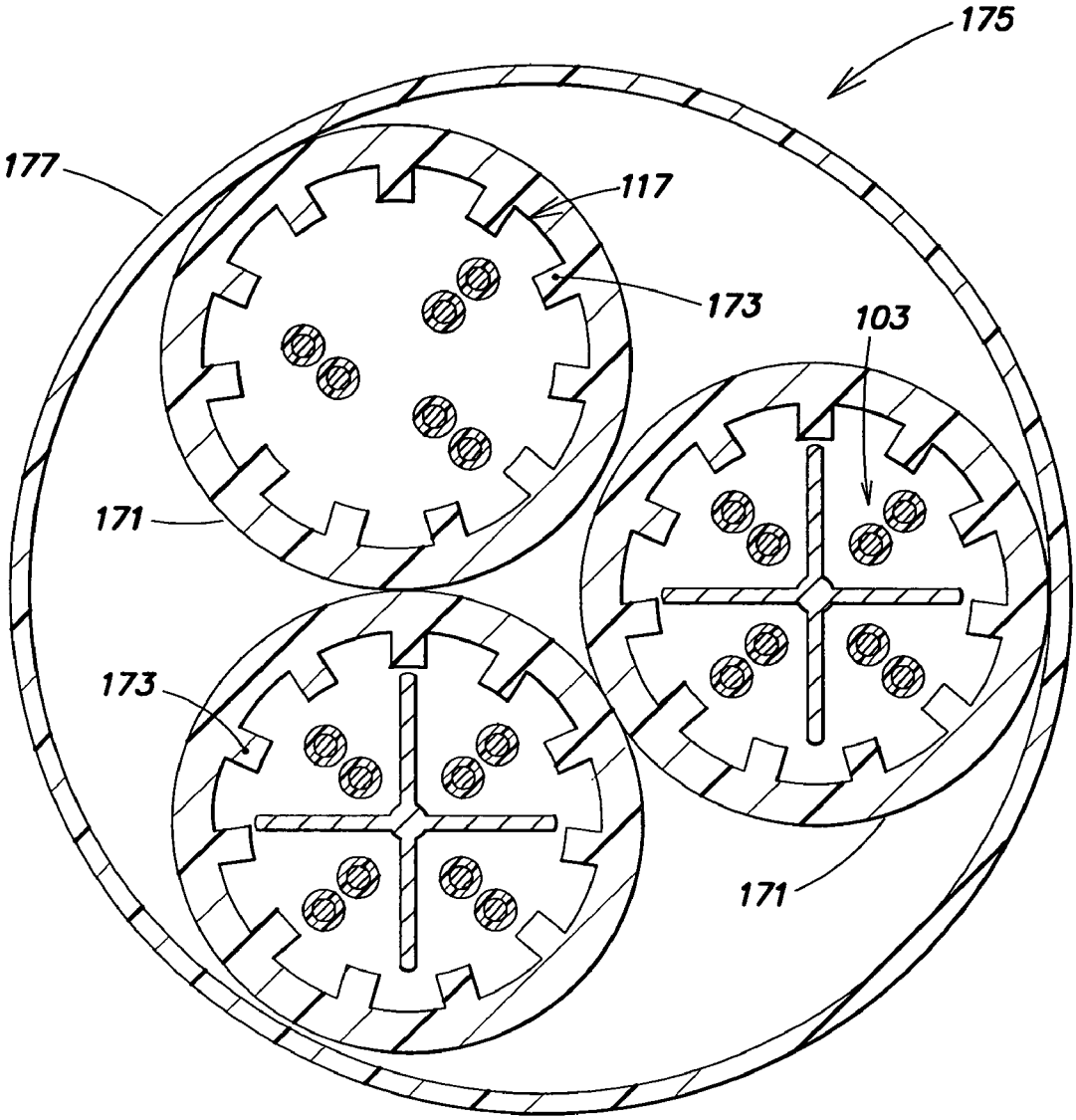
FIG. 13 is an illustration of yet another embodiment of cables having jackets with inwardly extending projections, according to the invention.

According to another embodiment, the cable 117 may be provided with a striated jacket 171 having a plurality of inwardly extending projections 173, as shown in FIG. 13. Such a jacket construction may be advantageous in that the projections may result in relatively more air separating the jacket 171 from the twisted pairs 103 compared with a conventional jacket. Thus, the jacket material may have relatively less effect on the performance characteristics of the twisted pairs 103. For example, the twisted pairs may exhibit less attenuation due to increased air surrounding the twisted pairs 103. In addition, because the jacket 171 may be held further away from the twisted pairs 103 by the protrusions 173, the protrusions 173 may help to reduce alien crosstalk between adjacent cables 117 in a bundled cable 175. The cables 117 may again be wrapped in. for example, a polymer binder 177 to form the bundled cable 175.

Having thus described several aspects of at least one embodiment of this invention, it is to be appreciated various alterations, modifications, and improvements will readily occur to those skilled in the art. For example, any of the cables described herein may include any number of twisted pairs and any of the jackets, insulations and separators shown herein may comprise any suitable materials. In addition, the separators may be any shape, such as, but not limited to, a cross- or star-shape, or a flat tape etc., and may be positioned within the cable so as to separate one or more of the twisted pairs from one another. Such and other alterations, modifications, and improvements are intended to be part of this disclosure and are intended to be within the scope of the invention. Accordingly, the foregoing description and drawings are by way of example only and the scope of the invention should be determined from proper construction of the appended claims, and their equivalents.

What is claimed is:

1. A shielded cable comprising a plurality of twisted pairs of insulated conductors including a first twisted pair and a second twisted pair;

a core disposed between the plurality of twisted pairs of insulated conductors so as to separate the first twisted pair from the second twisted pair along a length of the shielded cable;

a dual-layer jacket enclosing the core and the plurality of twisted pairs of insulated conductors, the dual-layer jacket including a first jacket layer and a second jacket layer; and a conductive shield disposed between the first jacket layer and the second jacket layer;

wherein at least one of the first jacket layer and the second jacket layer comprises a plurality of protrusions.

2. The shielded cable as claimed in claim 1, wherein the core comprises a plurality of pinch points disposed along the length of the core, a diameter of the core at each of the plurality of pinch points being substantially reduced compared with a maximum diameter of the core.

3. A bundled cable comprising a first cable including a plurality of twisted pairs of insulated conductors and a first separator arranged between the plurality of twisted pairs so as to separate one of the plurality of twisted pairs from others of the plurality of twisted pairs, the first cable having a first jacket; and a second cable including a plurality of twisted pairs of insulated conductors and a second separator arranged between the plurality of twisted pairs so as to separate one of the plurality of twisted pairs from others of the plurality of twisted pairs, the second cable having a second jacket;

wherein each of the first and second jackets comprises a plurality of protrusions; and wherein the plurality of protrusions of the first jacket are inwardly projecting and have a first spacing sufficiently small so as to prevent any one of the plurality of twisted pairs of insulated conductors from lying in between adjacent ones of the plurality of protrusions.

4. The bundled cable as claimed in claim 3, wherein the plurality of protrusions of the second jacket are inwardly projecting.

5. The bundled cable as claimed in claim 3, wherein the first and second separators are non-conductive.

6. The bundled cable as claimed in claim 3, wherein the bundled cable is helically twisted in an oscillating manner such that the bundled cable comprises a first region having a clockwise twist lay and a second region having an anti-clockwise twist lay.

7. A bundled cable comprising:

a first cable including a plurality of twisted pairs of insulated conductors and a first separator arranged between the plurality of twisted pairs so as to separate one of the plurality of twisted pairs from others of the plurality of twisted pairs, the first cable having a first jacket; and a second cable including a plurality of twisted pairs of insulated conductors and a second separator arranged between the plurality of twisted pairs so as to separate one of the plurality of twisted pairs from others of the plurality of twisted pairs, the second cable having a second jacket;

wherein each of the first and second jackets comprises a plurality of protrusions;

wherein the plurality of protrusions of each of the first and second jackets are outwardly projecting, and wherein the first and second jackets are adapted to mate with one another so as to lock the first cable to the second cable.

8. A cable comprising:

a plurality of twisted pairs of insulated conductors including a first twisted pair and a second twisted pair;

a core disposed between the plurality of twisted pairs of insulated conductors so as to separate the first twisted pair from the second twisted pair; and a jacket surrounding the plurality of twisted pairs of insulated conductors and the core;

wherein the first twisted pair has a first twist lay, a first insulation thickness and a first nominal impedance;

wherein the second twisted pair has a second twist lay, smaller than the first twist lay, a second insulation thickness and a second nominal impedance that is lower than the first nominal impedance; and wherein the first and second twist lays and the first and second nominal impedances are selected such that a skew between the first and second twisted pairs is less than about 21 nanoseconds per 100 meters and a difference between the first and second nominal impedances is between approximately 2 Ohms and 15 Ohms.

9. The cable as claimed in claim 8, wherein the first insulation thickness is substantially the same as the second insulation thickness.

10. The cable as claimed in claim 8, wherein the first insulation thickness is larger than the second insulation thickness.

11. A cable comprising:

a plurality of twisted pairs of insulated conductors;

a separator arranged between the plurality of twisted pairs so as to separate one of the plurality of twisted pairs from others of the plurality of twisted pairs; and a jacket comprising a plurality of protrusions extending away from an internal surface of the jacket such that the plurality of protrusions extend into the cable toward the plurality of twisted pairs of insulated conductors, and wherein the plurality of protrusions are sufficiently closely spaced to prevent any of the plurality of twisted pairs from lying between adjacent ones of the plurality of protrusions.

12. The cable as claimed in claim 11, further comprising an outer jacket surrounding the jacket.

13. The cable as claimed in claim 12, wherein the outer jacket comprises a further plurality of protrusions.

14. A cable comprising:

a plurality of twisted pairs of insulated conductors;

a separator arranged between the plurality of twisted pairs so as to separate one of the plurality of twisted pairs from others of the plurality of twisted pairs; and a first jacket surrounding the plurality of twisted pairs and the separator; and a second jacket surrounding the first jacket;

wherein at least one of the first jacket and the second jacket comprises a plurality of protrusions extending away from a surface of the respective one of the first jacket and the second jacket.

15. The cable as claimed in claim 14, wherein the first jacket comprises the plurality of protrusions.

16. The cable as claimed in claim 15, wherein the plurality of protrusions extend away from an inner surface of the first jacket toward the plurality of twisted pairs of insulated conductors, and wherein the plurality of protrusions are sufficiently closely spaced to prevent any of the plurality of twisted pairs from lying between adjacent ones of the plurality of protrusions.

17. The cable as claimed in claim 16, wherein the second jacket comprises a further plurality of protrusions extending away from a surface of the second jacket.

18. The cable as claimed in claim 14, wherein the second jacket comprises the plurality of protrusions.

19. The cable as claimed in claim 18, wherein the plurality of protrusions extend away from an exterior surface of the second jacket.

20. The cable as claimed in claim 19, wherein the first jacket comprises a further plurality of protrusions extending away from an interior surface of the first jacket toward the plurality of twisted pairs of insulated conductors, and wherein the plurality of protrusions are sufficiently closely spaced to prevent any of the plurality of twisted pairs from lying between adjacent ones of the plurality of protrusions.

21. The cable as claimed in claim 14, wherein the first jacket layer comprises a foamed polymer.

22. A bundled cable comprising:

a first cable including a plurality of twisted pairs of insulated conductors and a first jacket, the first jacket including a first plurality of projections extending outwardly from an outer surface of the first jacket;

a second cable including a plurality of twisted pairs of insulated conductors and a second jacket, the second jacket including a second plurality of outwardly projecting protrusions;

wherein the first cable is twisted in a helical manner with a first cable lay so as to provide a first twisted cable;

wherein the second cable is twisted in a helical manner with a second cable lay so as to provide a second twisted cable; and wherein the bundled cable further comprises an overall jacket surrounding the first and second twisted cables along a length of the bundled cable.

23. The bundled cable as claimed in claim 22, further comprising a binder disposed beneath the overall jacket and around the first and second twisted cables.

* * * * *

US007154043C1

(12) EX PARTE REEXAMINATION CERTIFICATE (6923rd)

United States Patent

Clark

(10) Number: US 7,154,043 C1

(45) Certificate Issued: *Jul. 7, 2009

(54) DATA CABLE WITH CROSS-TWIST CABLED CORE PROFILE

(75) Inventor: William T. Clark, Lancaster, MA (US)

(73) Assignee: Belden Technologies, Inc., St. Louis, MO (US)

Reexamination Request:
No. 90/008,459, Feb. 1, 2007

Reexamination Certificate for:

| | |
|---|---|
| Patent No.: | **7,154,043** |
| Issued: | **Dec. 26, 2006** |
| Appl. No.: | **10/705,672** |
| Filed: | **Nov. 10, 2003** |

( * ) Notice: This patent is subject to a terminal disclaimer.

Related U.S. Application Data

(63) Continuation-in-part of application No. 10/430,365, filed on May 5, 2003, now abandoned, which is a continuation of application No. 09/532,837, filed on Mar. 21, 2000, now Pat. No. 6,596,944, which is a continuation of application No. 08/841,440, filed on Apr. 22, 1997, now Pat. No. 6,074,503.

(51) Int. Cl.
*H01B 7/00* (2006.01)
*H01B 7/17* (2006.01)

(52) U.S. Cl. ..... 174/113 R; 174/113 C; 174/27

(58) Field of Classification Search ..... 174/116
See application file for complete search history.

(56) References Cited

U.S. PATENT DOCUMENTS

| | | | | |
|---|---|---|---|---|
| 5,238,328 | A * | 8/1993 | Adams et al. | 405/183.5 |
| 5,796,046 | A | 8/1998 | Newmoyer et al. | |
| 7,135,641 | B2 | 11/2006 | Clark | |
| 2004/0055779 | A1 | 3/2004 | Wiekhorst et al. | |
| 2004/0216913 | A1 | 11/2004 | Wiekhorst et al. | |

FOREIGN PATENT DOCUMENTS

| | | |
|---|---|---|
| GB | 725624 | 3/1955 |
| WO | 01/29848 | 3/2001 |

* cited by examiner

*Primary Examiner*—Jeffrey L. Gellner

(57) ABSTRACT

Cables including a plurality of twisted pairs of insulated conductors and a core disposed between the plurality of twisted pairs of insulated conductors so as to separate at least one of the plurality of twisted pairs of insulated conductors from others of the plurality of twisted pairs of insulated conductors. In one example, a cable may include a jacket having a plurality of protrusions. In another example, the core may include one or more pinch points to facilitate breaking of the core. In yet another example, two or more cables may be bundled, and possibly twisted, together to form a bundled cable.

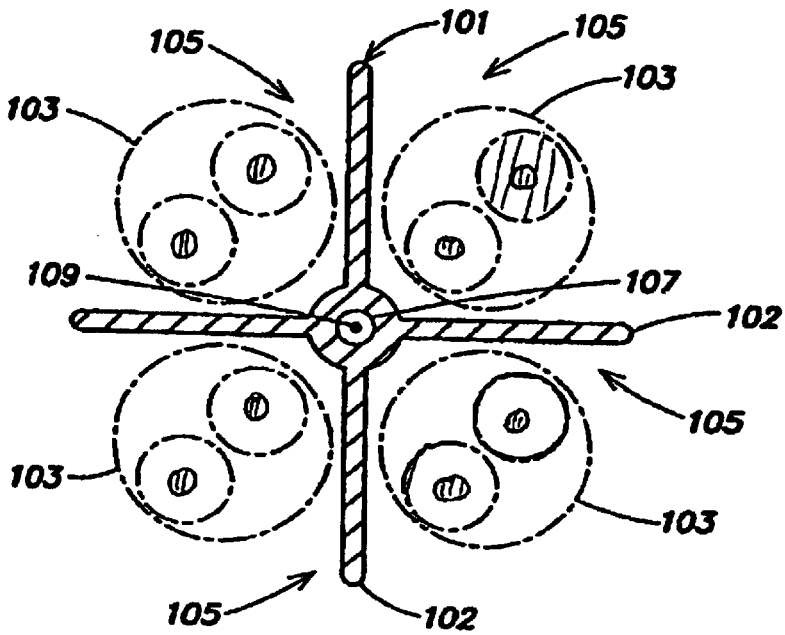

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 3–5 is confirmed.
Claims 11–13 are cancelled.
Claims 1, 2, 6–10 and 14–23 were not reexamined.

* * * * *